US005836364A

United States Patent [19]

Burton

[11] Patent Number: 5,836,364

[45] Date of Patent: Nov. 17, 1998

[54] REFILLABLE PRESSURIZED BEVERAGE CONTAINER

[76] Inventor: John W. Burton, 4 Woodland Dr., Pittsburgh, Pa. 15228

[21] Appl. No.: 580,814

[22] Filed: Dec. 29, 1995

[51] Int. Cl.[6] ..... B65B 1/04; B65B 3/00; B67C 3/00

[52] U.S. Cl. ..... 141/348; 141/2; 141/4; 141/18; 141/29; 141/64; 141/292; 222/397; 215/228; 215/307; 261/DIG. 7; 99/323.1

[58] Field of Search ..... 141/2, 3, 4, 18, 141/21, 29, 63, 64, 348, 349, 292, 296, 14, 15, 197, 67, 289; 222/400.7, 635, 396, 397; 215/228, 307, 341, 343; 220/212; 99/323.1, 323.2; 261/DIG. 7

[56] References Cited

U.S. PATENT DOCUMENTS 4,411,163 10/1983 White ..... 73/864.02
4,623,076 11/1986 Karpal ..... 222/482
4,911,212 3/1990 Burton ..... 141/369
4,984,717 1/1991 Burton ..... 222/183

*Primary Examiner*—Henry J. Recla
*Assistant Examiner*—Timothy L. Maust
*Attorney, Agent, or Firm*—Buchanan Ingersoll, P.C.; Lynn J. Alstadt

[57] ABSTRACT

A refillable bottle constructed to be capable of holding fluids above atmospheric pressure has a threaded cap. The top of the threaded cap has at least one valve having a single resealable passageway for filling, pressurizing and emptying the container. The valve is capable of being opened by a probe which engages the valve and pushes into the cap, the valve being closed when not acted upon by the probe. A plurality of vent holes are positioned in the top so as to be adjacent the mouth of the bottle when the cap is placed thereon. A releasable sealing ring is sized and positioned between the mouth and the cap so as to close the vent holes when the cap is fully threaded onto the neck and allow gas within the container to escape through the vent holes when the cap is loose.

16 Claims, 3 Drawing Sheets

REFILLABLE PRESSURIZED BEVERAGE CONTAINER

FIELD OF INVENTION

The present invention relates to pressurized containers for holding and dispensing beverages and other fluids under pressure.

BACKGROUND OF THE INVENTION

A number of containers have been developed for holding and dispensing carbonated beverages and other liquids, pastes and powders under pressure. Perhaps the most common are carbonated beverage bottles and cans as well as aerosol spray cans. One problem with conventional carbonated beverage bottles and cans is that after the container is opened the pressurized gas escapes causing the beverage to go "flat." Consequently, any carbonated beverage will lose its carbonation if left to stand after the container has been opened. Some bottles are factory refillable while other bottles and cans are disposable.

Aerosol cans have been used to dispense a variety of liquids, pastes and powders, but not beverages. These containers generally retain the pressurized gas charge until most, if not all, of the material has been dispensed. These cans or bottles are generally not refillable having a can and valve assembly designed for a single filling at the factory.

The cost of the container, particularly disposable containers, are added to the purchase price of the product. Additionally, the user normally pays a bottle deposit on refillable bottles. Many states also require deposits or fees be paid on disposable containers to discourage littering.

There are, of course, large, pressurized containers which have been used for soft drink dispensing systems. These containers have large removable caps or lids for filling rather than filling through a single pressure tight valve. Also, gas pressure in conventional carbonated beverage dispensing machine cans or bottles is supplied through a second can valve from an external source of carbon dioxide. One container valve is used for gas pressurizing the container and the second is used for dispensing the product.

In my U.S. Pat. No. 4,984,717 I disclose a refillable bottle which can be used for pressurized fluids such as carbonated beverages and which will allow the beverage to hold its carbonation after some or almost all of the product has been removed from the bottle. This bottle has a single resealable passageway containing a valve which is opened by a filler probe or a discharge nozzle. The bottle is particularly suited for filling by the filling machine disclosed in my U.S. Pat. No. 4,911,212. However, the single passageway through my prior refillable bottle does not permit simultaneous filling and venting of the bottle, as well as means to purge air from a thin wall bottle.

Vents have been provided in bottles and other pressurized containers. The primary purpose of these vents has been to relieve the internal pressure in the pressurized container as the container is opened. One approach has been to provide vents in the side wall of the cap. An example of such a bottle is disclosed in U.S. Pat. No. 4,623,076.

For some beverages such as beer, sodas, or juices it is desirable to have a pressurized bottle which can through some sequence be purged of air through venting and gas pressurizing, partially filling with a liquid of choice, and then sealing both vents and the bottle cap to the container, followed by gas pressurizing to a higher pressure if desired, all accomplished through a computer controlled, on site filling machine at the retail outlet. Yet, the prior art containers that have check valves, vents, or filling, pressurizing, or dispensing valves are either relatively expensive or cannot be easily pressurized after the vents have been opened. Consequently, there is a need for a disposable or refillable, bottle which can be sequentially vented, purged, sealed, filled, and repressurized in an automatic filling machine.

SUMMARY OF THE INVENTION

The present invention provides a refillable bottle having a removable cap with vent holes and a single valve through which the bottle is purged of air, filled, pressurized and emptied. The vent holes are positioned through the top of the cap to be adjacent a detachable seal placed on the mouth of the bottle. Such a bottle can be made in a manner similar to that used to make the conventional two liter and three liter soft drink bottles now in the marketplace. The bottle is fabricated of polyethylene terephthalate (PET) or other plastic of choice suitable for blow molding. The valve preferably is a single, push type, basket valve which an external probe may engage for filling and pressurizing and to which a nozzle or tube can be connected for emptying the bottle. The valve is provided with openings of sufficient size to permit rapid filling and discharge of the bottle. The vent holes and seal are positioned so that rotation of the cap opens and closes the vent holes. Preferably this can be done by rotating the cap 180° relative to the bottle. Therefore, the bottle can be vented and sealed by rotation of the bottle or cap relative to one another in a bottle filling machine. A partial void in the bottle after filling provides a pressurized gas pack of nitrogen, carbon dioxide, or any combination of gas or gases to protect the carbonation and integrity of the beverage, as well as to act as a pusher to discharge all contents of the bottle through a bottle discharge device or top, or to a remote location.

DESCRIPTION OF THE PREFERRED EMBODIMENTS

Figure 1:
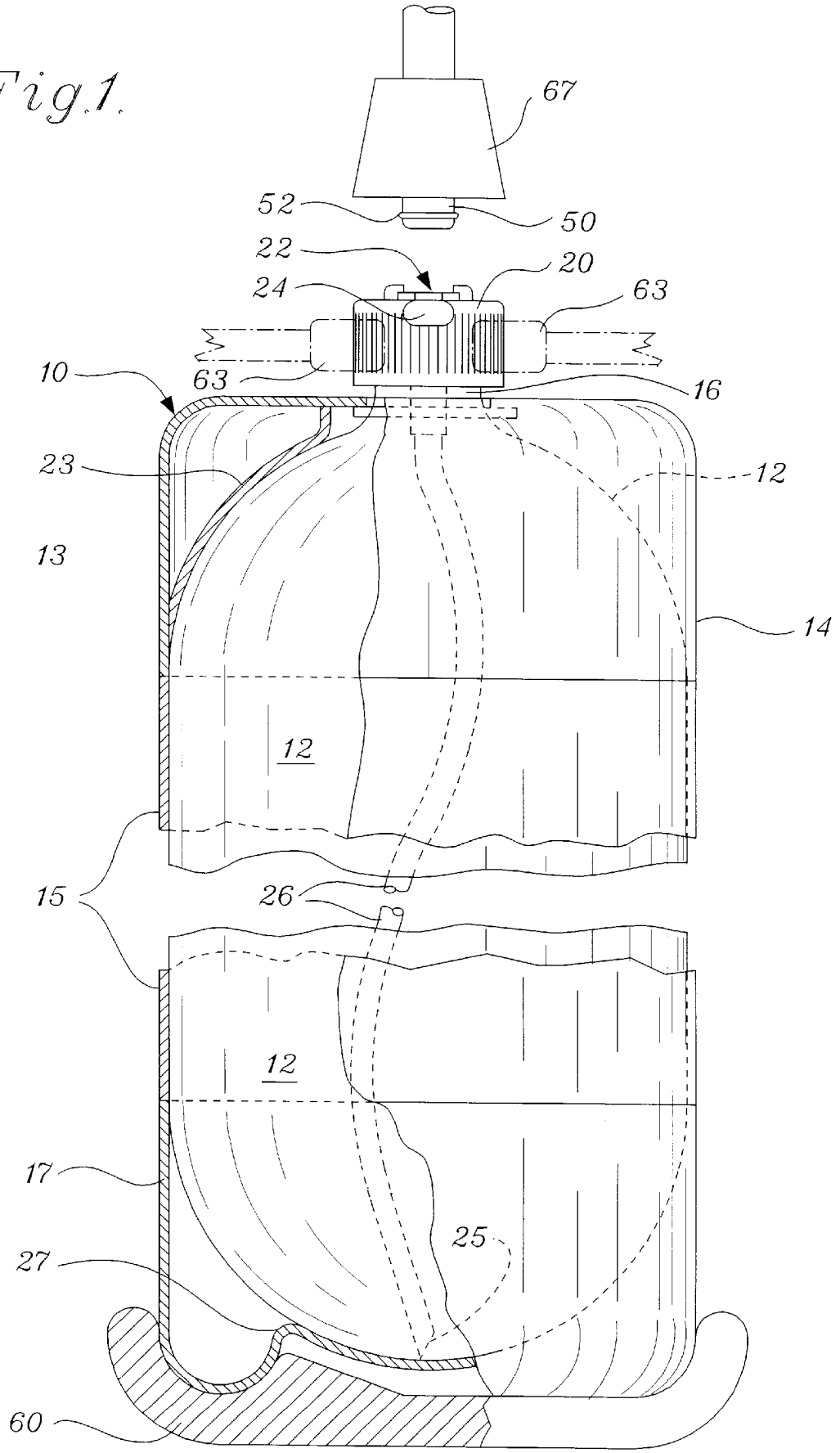
FIG. 1 is a side view, partially in section, of the present preferred embodiment of my container; placed within an automatic filling machine, and showing a spring-type locking device to lock a dispensing probe to cap.

Referring to FIG. 1, I provide a bottle 10, preferably having an inner shell 12, which is blow molded from plastic in the conventional manner. The shell 12 could also be made from non-corrosive materials such as aluminum, stainless steel or other material which meets FDA standards for food and beverage containers. Attached to the inner shell is an optional outer shell 14 which I prefer to make in three pieces. First there is a reinforcing wrap 15 made of a strong plastic or metal, such as stainless steel or aluminum, which is wrapped about the center of the inner shell 12. This reinforcement is applied by cementing the layer to the inner shell. Alternatively, it may be placed in a blow mold when the inner shell is made and attached during molding. I also provide an upper end portion 13 of the outer shell which is attached to the upper portion of the inner shell 12 by cementing or during molding. Finally, there is a lower portion of the outer shell 17 which is similarly made of metal or hard plastic to provide reinforcement. This too can be cemented to the inner shell 12 or made a portion of the inner shell during molding. Because the bottle is designed to withstand both vacuum or negative pressure as well as to function above atmospheric pressures, I may design the top portion 13 so that it has an inner surface 23 which conforms and attaches to the inner shell 12 as shown in FIG. 1. Similarly, an inner surface 27 is provided on the bottom portion 17 and is attached to inner shell 12 by cementing or during molding. The inner surface 27 of the bottom portion conforms to and covers a substantial part of the bottom of the inner shell. For a container that will contain beer, juice, or a carbonated beverage, a blow molded PET or other plastic bottle without the outer shell is satisfactory.

Figure 2:
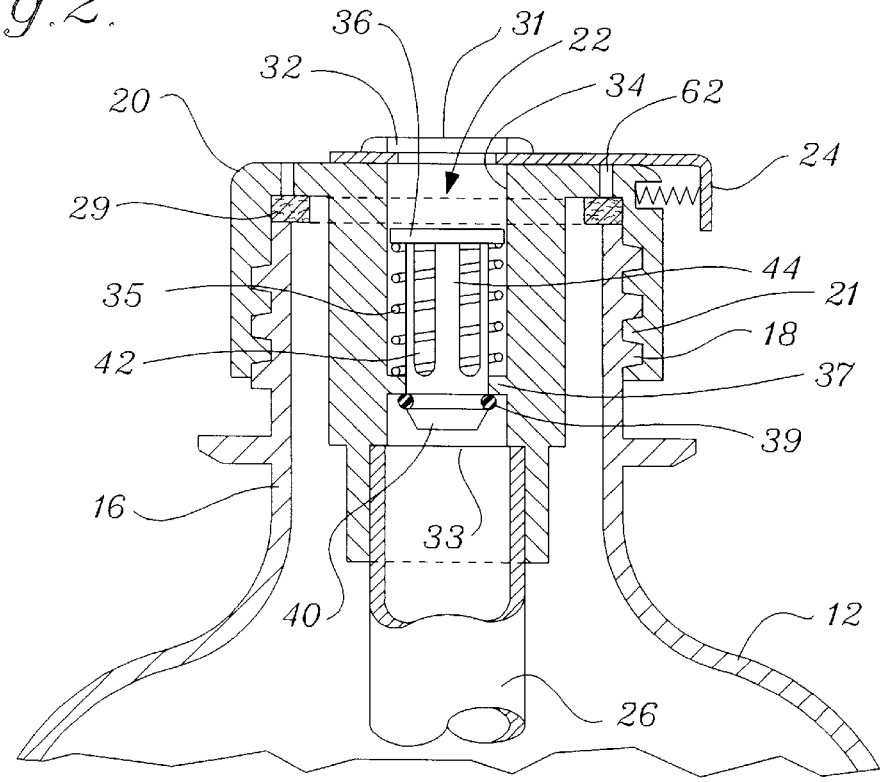
FIG. 2 is a sectional view of the cap and valve portion used in the embodiment of FIG. 1.

As shown in FIG. 2 I prefer to provide a conventional mouth 16 having outer threads 18 for receipt of a cap 20. Within the cap I provide a valve 22 having an optional outer lock 24 or 66. A detachable sealing ring 29 is placed in the cap to releasably engage and seal the mouth of the bottle. A plurality of vent holes 62 are provided in the cap 20. The vent holes 62 are positioned to be aligned over the seal of 29 located between the cap 20 and the mouth of the bottle. Preferably at least one vent hole is positioned so that a hypodermic needle connected to a pressurized gas source can be inserted through the vent hole and the sealing ring. Then gas can be injected through the needle to pressurize the bottle. I prefer to provide eight vent holes, each 1/32" in diameter. The seal 29 is formed of neoprene or other elastomeric material. Moreover, that seal is constructed to be detachable from the cap 20 and the mouth of the bottle. Consequently, when the cap is rotated from a closed sealed position to a loose position, air or other gas can escape from the bottle. The use of a removable screw cap 20 also permits easy cleaning and sterilization of the bottle. Finally, I provide a flexible dip tube 26 which extends from valve 22. A replaceable dip tube may be used in place of the dip tube. The contents of the bottle and internal gas pack should be under sufficient pressure to force those contents through the dip tube and valve 22 when the valve is open. Consequently, no propellant need be added to my refillable bottle after filling to discharge the contents. I prefer to terminate the dip tube at an angle 25. Also, tube 26 does not quite reach the bottom of the inner shell so that when the bottle is tipped on its side it will lay against the side. For that reason, I am able to dispense all of the contents of my container when it is either in the vertical position, or in a horizontal position. The dip tube 26 should be made of a flexible material such as rubber or plastic.

The bottle can be automatically filled and vented in a filling machine having a rotatable table 60 on which the bottle is placed. In that machine a pair of side grippers 63 or a vertically descending cone gripper 67 grasps the cap 20. Preferably the bottle is placed on the table 60 with the cap 20 lightly tightened. The table 60 is configured to securely hold the bottle. As the table 60 rotates, side grippers 63 or cone gripper 67 prevents the cap 20 from turning. The threads are sized so that rotation of the bottle by as little as 180° loosens cap 20 sufficiently to open the vent holes 62 and space between seal 29 and bottle 10. The bottle is purged of air with another gas and/or filled by a probe connector 50 engaging valve 22, and vented through vent holes 62 and loose cap. Then the bottle is rotated in an opposite direction to fully close the cap and seal the vent holes. Then the bottle is pressurized with a gas of choice through the probe. The probe is removed closing valve 22 and completing the filling process. A position marker such as an arrow 65 can be molded into the cap to readily identify the relative position of the cap during and after rotation of the bottle, or for manual loosening of cap for purging or venting if so desired.

Figure 3:
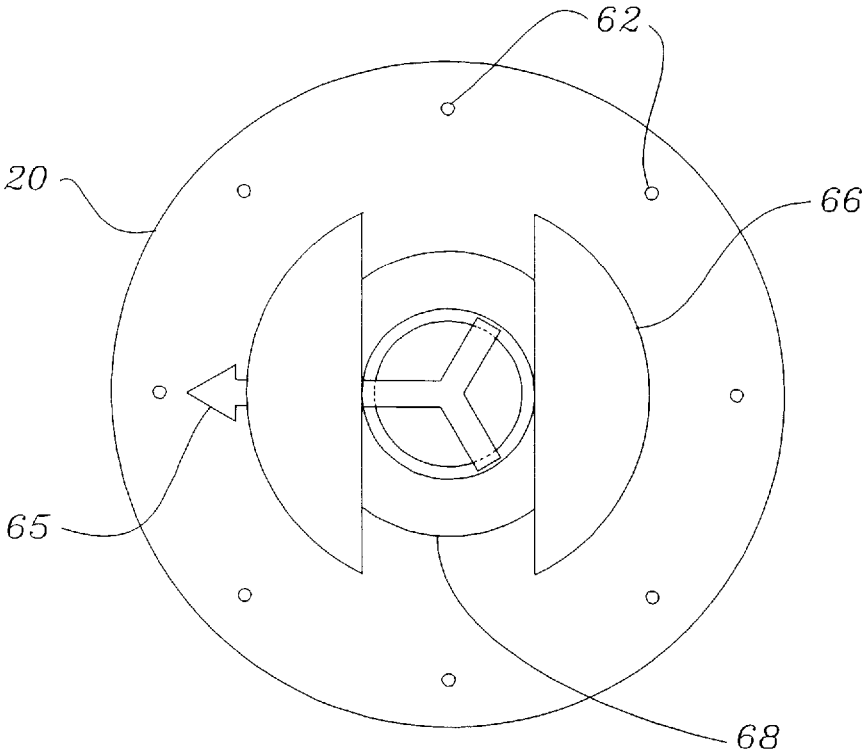
FIG. 3 is a top plan view a cap with an alternate style molded in bayonet dispensing probe locking device.
Figure 4:
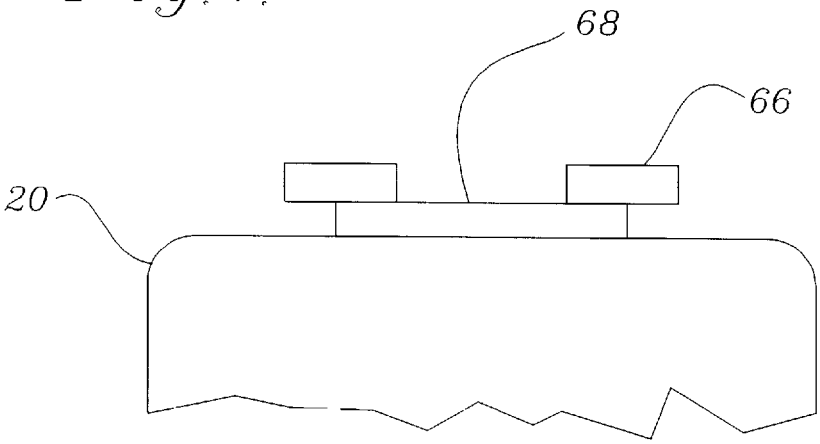
FIG. 4 is a side view of the cap shown in FIG. 3.

In FIGS. 2, 3 and 4, I have shown two present preferred embodiments of the cap and valve arrangement. The cap 20, which can be made of metal or plastic, is preferably molded of plastic to have inner threads 21 which mate with threads 18 on the mouth of the bottle. An O-ring seal 29 is aligned with the vent holes 62 and seals any gap between the cap and the mouth of the bottle. Within the cap there is a valve 22. This valve consists of a generally cylindrical-outer housing 32 with openings 31 and 33. Within housing 32 is a basket 34 which rests on springs 35. This spring is positioned between upper rim 36 of basket 34 and shoulder 37. The basket is closed at its bottom 40, but has a plurality of slots 42 in the side wall 44. Preferably the slots are sized to provide a combined open area of about 0.25 square inches which allows me to fill and pressurize a two liter container to 60 p.s.i. in less than 30 seconds. That container can fill twelve ounce cups in about ten seconds. Furthermore, the valve allows me to dispense liquid contents of my bottle in a continuous liquid stream, a foam, or spray. The valve is operated by inserting a probe 50. When the probe is removed the basket returns to its original position shown in FIG. 2. This allows me to dispense a portion of a carbonated beverage from my bottle without destroying or adversely affecting the carbonation of the contents or pressurized gas pack which remain in the bottle. An exterior seal 39 is provided on the lower portion of the basket 34. Dip tube 26 is attached to the cap in any conventional manner such as providing a force fit as shown in FIG. 2. If bottles are being used for several different types of fluids one may make the cap 20, the valve 22 or both in different sizes. Only one size is used for a given fluid to prevent or discourage the user from filling a bottle with an incorrect or inappropriate fluid. Otherwise, my bottle can be filled and refilled with any liquid and any gas chosen by the user. One may also incorporate a pressure relief valve in the cap.

Figure 5:
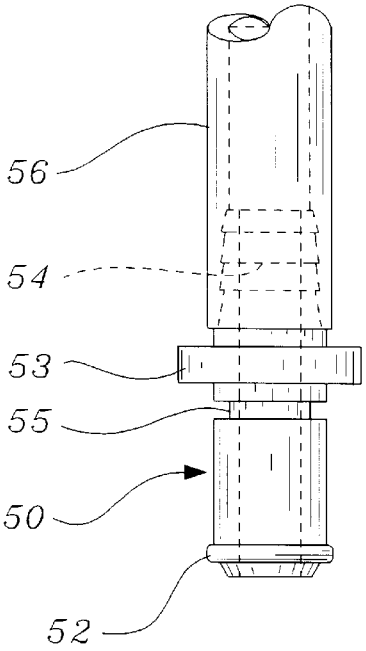
FIG. 5 is a side view of one type of probe which can be inserted into the valve for filling, pressurizing or dispensing product from the bottle.
Figure 6:
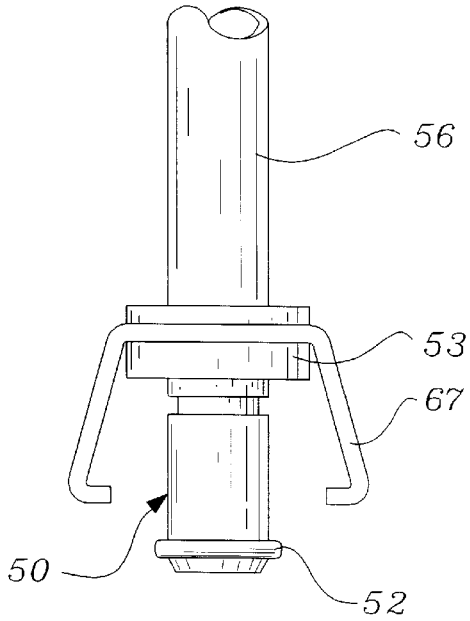
FIG. 6 is a side view of a probe having a bayonet lock for mating the locking device on the cap shown in FIGS. 3 and 4.

Turning to FIG. 5 connector fitting 50 is a generally cylindrical tube having an O-ring seal 52 about its lower end. This end is inserted into valve 22 and pushes valve basket 34 shown in FIG. 2 opening the valve. Seal 52 mates with the inner surface of the valve to prevent liquid from flowing around the outside of the probe. A shoulder 53 is provided on the probe for ease of inserting and removing the probe from the valve. Slot 55 can be engaged by a lock means 24 on the cap shown in FIGS. 1 and 2. A remote tube 56 can be fitted over the opposite end 54 of the probe. This tube can be used for remote dispensing of product from the bottle or filling the bottle. The tube may be attached to the probe in any conventional manner and may be flexible or rigid. An alternate means to lock a connector fitting to valve 22 is provided in the cap shown in FIGS. 3 and 4. A bayonet lock 67 on the probe 50 in FIG. 6 fits through slot 68 in mating bayonet lock 66 molded into cap 20. A 90 degree turn locks connector to valve and cap.

Although the present bottle is particularly useful for beer and carbonated beverages it can be used for any fluid including, but not limited to, fine powders, paints and other coatings, liquid foods, cooking liquids, perfumes, creams, liquid soaps, cosmetics, personal care products, liquid waxes, insecticides, fertilizers, glue, mastics, spray paints, aerosol products, lubricants, wine, wine coolers, juices and carbonated juices. I have found that this bottle is particularly useful for packaging, storing, and serving all types of carbonated beverages, soft drinks, beer, wine, wine coolers, carbonated and uncarbonated juices and juice drinks. By design, the valve cap and bottle package convert to a highly portable bar-tap, that reseals itself after dispensing.

Although the bottle and cap can be made of a variety of materials, I prefer to use plastics which enable the bottle and cap to be easily sterilized. Blow molded polyethylene terephthalate is one such plastic.

While I have shown several present preferred embodiments of the invention, it is to be distinctly understood that the invention is not limited thereto, but may be variously embodied within the scope of the following claims.

I claim:

1. A refillable container comprised of:

a. a bottle having an externally threaded neck and mouth at a distal end of the neck and constructed to be capable of holding fluids above atmospheric pressure;

b. a threaded cap threaded onto the neck, the threaded cap having:

i. a top;

ii. at least one valve in the top having a single resealable passageway for filling, pressurizing and emptying the container, the at least one valve being capable of being opened by a probe which engages the valve and pushes into the cap, the valve being closed when not acted upon by the probe, and iii. a plurality of vent holes positioned in the top so as to be adjacent the mouth of the bottle when the cap is placed thereon; and c. a releasable sealing ring sized and positioned between the mouth and the cap so as to close the vent holes when the cap is fully threaded onto the neck and allow gas within the container to escape through the vent holes when the cap is loose.

2. The container of claim 1 wherein the bottle is composed of a noncorrosive material selected from the group consisting of plastic, stainless steel and aluminum.

3. The container of claim 1 wherein the cap is a molded plastic cap.

4. The container of claim 1 wherein the valve is spring loaded and can be opened by pushing a probe through the passageway, said probe preferably being a hollow tube having an exterior seal for filling and dispensing fluids and creating a seal between the probe and valve passageway.

5. The container of claim 1 sized and constructed to accommodate and withstand a vacuum within the bottle.

6. The container of claim 1 wherein the valve and container are sized and configured to allow the container to be filled automatically by a filling machine.

7. The container of claim 1 also comprising a position marker on the cap.

8. The container of claim 1 also comprising a bayonet lock attached to the cap.

9. The container of claim 1 also comprising within the bottle a selected quantity of liquid and a sufficient quantity of a pressurized gas to eject all of the liquid from the bottle when the valve in the cap is opened.

10. The container of claim 1 wherein at least one vent hole and the releasable sealing ring are positioned so that a hypodermic needle connected to a pressurized gas source may be inserted through the vent hole and the sealing ring to pressurize the bottle and empty any liquid contained in the bottle when the valve in the cap is open.

11. The container in claim 1 also comprising a disposable, replaceable dip tube inserted through the at least one valve.

12. The container of claim 1 wherein at least one of the bottle and the threaded cap is sterilizable.

13. A method of automatically filling a container comprising the steps of a. placing on a table a sealed container comprised of i. a bottle having an externally threaded neck and mouth at a distal end of the neck and constructed to be capable of holding fluids above atmospheric pressure;

ii. a threaded cap threaded onto the neck, the threaded cap having: a top, at least one valve in the top having a single resealable passageway for filling, pressurizing and emptying the container, the at least one valve being capable of being opened by a probe which engages the valve and pushes into the cap, the valve being closed when not acted upon by the probe, and a plurality of vent holes positioned in the top so as to be adjacent the mouth of the bottle when the cap is placed thereon; and iii. a releasable sealing ring sized and positioned between the mouth and the cap so as to close the vent holes when the cap is fully threaded onto the neck and allow gas within the container to escape through the vent holes when the cap is loose;

b. grasping the cap with a gripper;

c. rotating one of the bottle and the cap relative to one another to open the plurality of vent holes;

d. engaging a probe with the valve so as to open the valve;

e. injecting a desired quantity of gases and liquid into the bottle through the probe;

f. rotating one of the bottle and the cap relative to one another to close the plurality of vent holes before or after injecting liquid fill;

g. injecting a gas through the probe to further pressurize the bottle;

h. removing the probe, and i. releasing the gripper from grasping the cap.

14. The method of claim 13 wherein the bottle is rotated 180° to open the plurality of vent holes.

15. The method of claim 14 wherein the table and bottle are rotated relative to the cap.

16. The method of claim 13 also comprising the step of injecting with the liquid.

* * * * *